United States Patent [19]

Hilaire

[11] 4,004,704

[45] Jan. 25, 1977

[54] TAMPER-PROOF CLOSURE WITH SAFETY MEANS

[75] Inventor: Fernand Hilaire, Monte Carlo, Monaco

[73] Assignee: Captocap Limited, Vaduz, Liechtenstein

[22] Filed: May 14, 1976

[21] Appl. No.: 686,597

[30] Foreign Application Priority Data

June 20, 1975 France ..... 75.19377

[52] U.S. Cl. ..... 215/220; 215/211; 215/217; 215/258

[51] Int. Cl.[2] ..... B65D 55/02; B65D 85/56; A61J 1/00

[58] Field of Search ..... 215/214, 217, 211, 220, 215/258

[56] References Cited

UNITED STATES PATENTS

| | | | |
|---|---|---|---|
| 3,830,390 | 8/1974 | Gach | 215/220 |
| 3,944,102 | 3/1976 | Grau | 215/214 X |

*Primary Examiner*—George T. Hall

[57] ABSTRACT

This tamper-proof plastic closure device with safety means comprises an internally screw-threaded plug matching the screw-threaded and beaded neck of a container. Said plug is retained by the neck bead engaging a groove formed in the outer skirt of said plug and the plug itself is covered by a cap in smooth frictional contact therewith; the central area of the internal surface of the flexible and bulged top wall of said cap which is bounded by a rigid projecting circular rib, comprising means adapted to co-act with matching means provided in the central area of said plug when a sufficient pressure is exerted on said area, so as to rotatably drive said plug and release same from said retaining bead. This closure device is intended more particularly for bottles that should not be opened by children.

6 Claims, 4 Drawing Figures

TAMPER-PROOF CLOSURE WITH SAFETY MEANS

BACKGROUND OF THE INVENTION

1. Field of the Invention

This invention relates in general to tamper-proof plastic closures for containers having a screw-threaded neck, and has specific reference to closures of this type comprising in addition a safety means intended more particularly for containers such as bottles or the like which should not be opened by children, for instance bottles containing drugs or other dangerous products.

2. Description of the Prior Art

In the U.S. Pat. No. 3,863,796 to Roy there is disclosed a safety closure device comprising an internal plug screwed to the neck of the container and housed in a covering cap formed on the inner peripheral surface of its upper wall with a series of teeth adapted to engage corresponding teeth formed on the outer peripheral surface of the upper wall of said plug when a pressure is exerted in the axial direction throughout the cap surface against the force of a central spring. However, this device is not tamperproof, since even a child can produce this meshing engagement by merely depressing the cap as a whole.

SUMMARY OF THE INVENTION

According to a first feature characterizing the closure device according to this invention, this device comprising an internally screw-threaded or tapped plug engaging on the one hand the externally screw-threaded neck of a container by which it is retained through the engagement of a bead formed integrally with the neck into a groove formed at the bottom of the external skirt of the plug, said tapped plug being furthermore surrounded in smooth frictional contact by a covering cap having a bulged and flexible top wall provided on its inner surface with central means adapted to engage means projecting from the central area of the plug when a sufficient pressure is exerted on said top flexible wall, to permit the release of said plug from said retaining ring and therefore the unscrewing of said plug.

According to another feature characterizing this invention, the outer surface of the top wall of said covering cap comprises around its bulged central area at least one circular rib acting as an abutment member for stopping the movement of said central area away from the registering central portion of the plug.

According to a further feature characterizing this invention, the means for rotatably driving the plug from said cap and thus opening the container or bottle comprise ribs formed on the outer surface of the central area of the plug and projections formed on the inner surface of the top wall of said covering cap, or vice versa. Said projections are adapted to engage and drive the ribs formed on the outer surface of the bottom of said plug when a sufficient pressure is exerted on the upper central flexible portion of the cap within the perimeter of said circular abutment-forming rib. To this end, the resistance of said cap to the necessary distortion may be calculated with a view to prevent a child from causing said cap and plug to come into mutual meshing engagement.

Thus, if one simply tries to unscrew, the assembly as would naturally occur to anybody, the cap will simply rotate loosely around the plug.

BRIEF DESCRIPTION OF THE DRAWING

A typical form of embodiment of the closure device according to this invention will now be described by way of example with reference to the attached drawing, in which.

DESCRIPTION OF THE PREFERRED EMBODIMENT

The closure device illustrated comprises an internally screw-threaded or tapped plug 1 and a complementary of covering cap 2.

Figure 1:
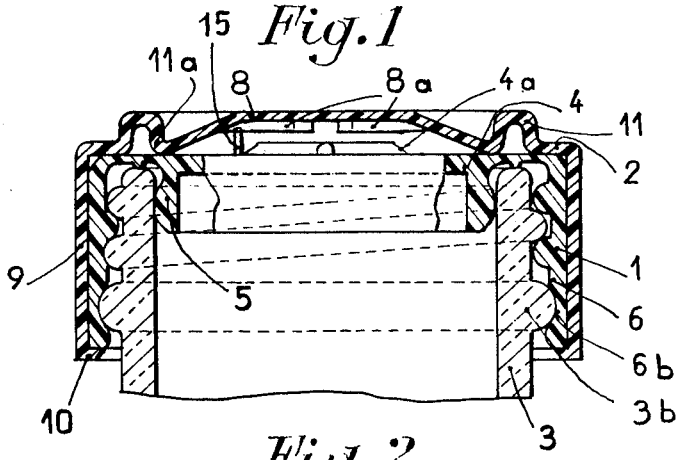
FIG. 1 is a diametral section showing the neck of a container to which a safety closure has been fitted.

The tapped plug 1 of any suitable type comprises in this example an internal skirt 5 and an external skirt 6 and is fitted to the screw-threaded neck 3 of a container, for example a bottle. Just beneath its tapped portion **3*a* the neck 3 comprises a circular bead 3*b* adapted to be force fitted into a circular groove 6*b* formed in the plug 1, when the latter has been screwed home and sunk with force. The plug 1 is thus retained on the neck 3 due to the penetration of the bead 3*b* thereof into the plug groove 6*b* (FIG. 1**).

Figure 2:
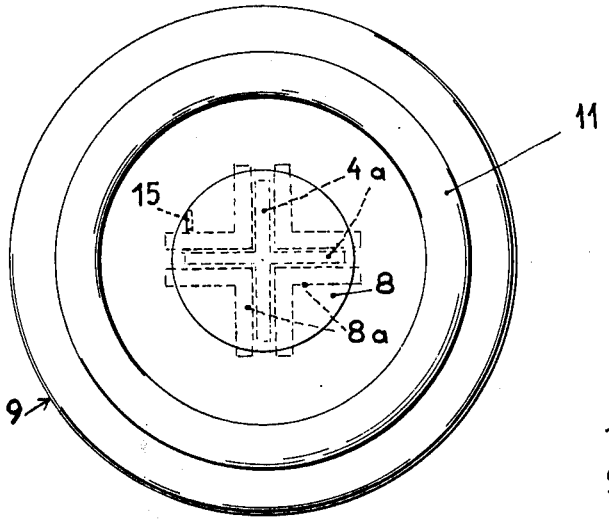
FIG. 2 is a plan view from above of the device illustrated in FIG. 1.

The bottom 4 of plug 1 comprises in the central carea of its top wall a plurality of ribs **4*a* forming for example a cross-shaped pattern (see FIG. 2**).

Figure 3:
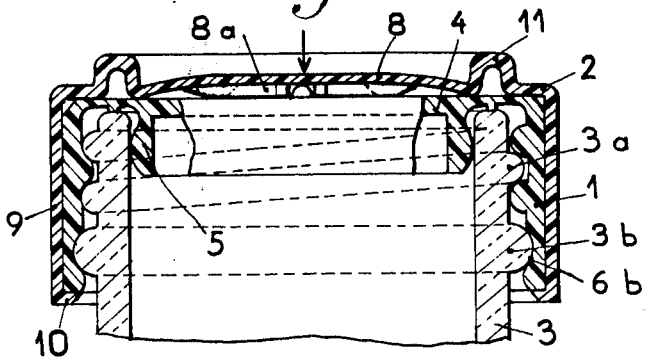
FIG. 3 is a similar to FIG. 1 but shows the closure plug ready to be unscrewed.

The covering cap 2 is fitted in smooth frictional contact over the plug 1 and comprises a circular top wall 8 and a lateral cylindrical skirt 9 of which the lower reinforced edge 10 constitutes a heel adapted to retain the plug 1 within said cap 2. The top wall 8 of suitable resilient material has a bulged central portion and comprises along its outer periphery and registering with the top edge of neck 3 a circular rib 11. This rib 11 bears with its inner edge **11*a* against the bottom 4 of plug 1 and acts as an abutment member for keeping the top wall 8 of cap 2 and the central portion of plug 1 somewhat spaced from each other. This abutment member 11 prevents any distortion of the top wall 8 of cap 2 when a pressure is exerted through the surface of the cap top wall 8. The central bulged portion of this wall 8 carries internal projections 8*a* adapted to fit into corresponding cavities formed in the outer surface of the bottom wall 4 of plug 1 by the cross-shaped ribs 4*a* when a pressure sufficient for producing the mutual meshing engagement of said projections 4*a* and 8*a* and therefore the driving contact between the plug 1 and cap 2 is exerted against the central area of the top wall 8 inside said abutment member 11 (FIG. 3**).

The closure device according to this invention operates as follows:

The plug 1 covered by the cap 2 is driven with force into the neck 3 of the container until the bead **3*b* of neck 3 engages the groove 6*b* of the plug. In this position the projections 8*a* of cap 2 do not contact the ribs 4*a* of plug 1. If one attempts to unscrew the plug in the usual was, the covering cap 2 will rotate freely in one or the other direction on the plug 1, without unscrewing the latter, since the bead 3*b* of neck 3 engaging the groove 6b plug 1 plug1 will hold the latter thereon, and if the top wall of cap 2 is depressed home the abutment member 11 will prevent the distortion of the central bulged portion 8**.

To unscrew the plug, an axial pressure must be exerted on the central bulged area of the top wall 8 of cap 2. This can be done for example by holding the cap-covered plug with the thumb and the second finger while exerting a pressure with the forefinger. In this case, the projections 8a will engage the cross-forming ribs 4a of plug 1 and drive the latter. The effort transmitted through the screw threads 3a permits of releasing the plug, the latter being freed from the bead 3b of neck 3 due to the resiliency of the plug material.

To refit the plug onto the neck it is only necessary to re-screw it while keeping the top wall 8 of cap 2 in meshing engagement with the bottom 4 of said plug, i.e. by exerting on the cap 2 the same pressure as when attempting to remove the closure.

This pressure is subordinate to the thickness of wall 8. This thickness will be selected to such a value that the effort to be exerted thereon be somewhat in excess of the effort that a child can exert with his or her fingers, while remaining easy for an adult, since the safety means of the closure device of this invention is intended more particularly for bottles or like containers that should not be opened by children.

Figure 4:
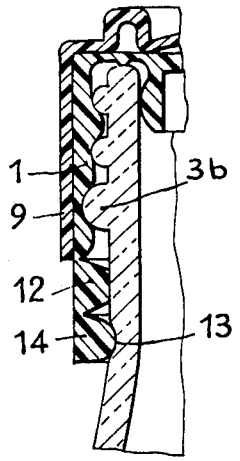
FIG. 4 is a fragmentary sectional view showing a modified form of embodiment wherein the neck of the container has been adapted for using a tear-off guaranty strip.

This structure may be used on a bottle having a neck contour designed for a tear-off strip 12 provided at the bottom edge of the skirt of plug 1 and retained by an integral bead 14 engaging a circular groove 13 formed in the neck beneath the bead 3b (FIG. 4), for example according to the structure disclosed in the French Pat. No. 7,405,926 filed on Feb. 21, 1974 in the name of Captocap Limited.

Various modifications and variations may be contemplated within the field of technical equivalence in the practical embodiment of this invention, without inasmuch departing from the basic principles thereof, as will occur to those conversant with the art. Thus, notably, the means for drivingly coupling the cap 2 and plug 1 by exerting a pressure on the top wall 8 of said cap may be inverted, i.e. by providing projections 8a on the plug 1 and the ribs 4a on the inner surface of the top wall of cap 2; besides, other means for causing the cap and plug to be drivingly interconnected at will may be contemplated within the scope of this invention.

Finally, to improve the safety characteristic of this invention, a thin flexible strip 15 may be provided on top of said plug 1 for frictionally engaging the projections of said cap when the latter rotates loosely, thus producing a characteristic rattle noise for warning that somebody is handling the container.

What is claimed as new is:

1. Tamper-proof plastic closure device with safety means for containers having a screw-threaded and beaded neck, which comprises on the one hand a plug having a tapped skirt adapted to be screwed on said neck and provided on the inner surface of its lower edge a groove adapted to receive the bead of said neck when said plug is screwed and driven home on said neck, and on the other hand a covering cap adapted to be fitted in smooth frictional engagement on the skirt of said plug and provided with a flexible top wall having a bulged central area, a circular abutment member formed on the outer surface of said top wall around said bulged central area, the height of said circular abutment member being at least equal to the height of said bulged central area, and means for drivingly coupling said bulged central area of said top wall of said cap to the central area of said plug bottom when a pressure is exerted from the outside in the axial direction against said bulged central area of said cap.

2. Tamper-proof plastic closure device with safety means for containers having a screw-threaded and beaded neck, which comprises on the one hand a plug having a tapped skirt adapted to be screwed on said neck and provided on the inner surface of its lower edge a groove adapted to receive the bead of said neck when said plug is screwed and driven home on said neck, and on the other hand a covering cap adapted to be fitted in smooth frictional engagement on the skirt of said plug and provided with a flexible top wall having a bulged central area, a circular abutment member formed on the outer surface of said top wall around said bulged central area, the height of said circular abutment member being at least equal to the height of said bulged central area, and cross-shaped ribs formed centrally of the outer surface of said plug and projections registering with said cross-shaped ribs on the centre of the flexible bulged central area of said cap.

3. Tamper-proof plastic closure device with safety means for containers having screw-threaded and beaded neck, which comprises on the one hand a plug having a tapped skirt adapted to be screwed on said neck and provided on the inner surface of its lower edge a groove adapted to receive the bead of said neck when said plug is screwed and driven home on said neck, and on the other hand a covering cap adapted to be fitted in smooth frictional engagement on the skirt of said plug and provided with a flexible top wall having a bulged central area, a circular abutment member formed on the outer surface of said top wall around said bulged central area, the height of said circular abutment member being at least equal to the height of said bulged central area, and cross-shaped ribs formed centrally of said flexible bulged central area of said cap and projections registering with said ribs and formed centrally of the outer surface of said plug.

4. Tamper-proof plastic closure device with safety means for containers having a screw-threaded and beaded neck, which comprises on the one hand a plug having a tapped skirt adapted to be screwed on said neck and provided on the inner surface of its lower edge a groove adapted to receive the bead of said neck when said plug is screwed and driven home on said neck, and on the other hand a covering cap adapted to be fitted in smooth frictional engagement on the skirt of said plug and provided with a flexible top wall having a bulged central area, a circular abutment member formed on the outer surface of said top wall around said bulged central area, the height of said circular abutment member being at least equal to the height of said bulged central area, means for causing the mutual driving engagement between said bulged central area of said top wall of said cap and said central area of the plug bottom when an axial pressure is exerted against the central area of the top wall of said cap, and a retaining heel formed along the lower edge of the skirt of said cap and engaging from beneath the bottom edge of the outer skirt of said plug.

5. Tamper-proof plastic closure device with safety means for containers having a screw-threaded and beaded neck, which comprises on the one hand a plug having a tapped skirt adapted to be screwed on said neck and provided on the inner surface of its lower edge a groove adapted to receive the bead of said neck when said plug is screwed and driven home on said neck, and on the other hand a covering cap adapted to be fitted in smooth frictional engagement on the skirt of said plug and provided with a flexible top wall having a bulged central area, a circular abutment member formed on the outer surface of said top wall around said bulged central area, the height of said circular abutment member being at least equal to the height of said bulged central area, means for causing the mutual driving engagement between said bulged central area of said top wall of said cap and said central area of the plug bottom when an axial pressure is exerted against the central area of the top wall of said cap, and a tear-off guarantee strip formed between the threads of said plug and the edge of the outer skirt of said plug.

6. Tamper-proof plastic closure device with safety means for containers having a screw-threaded and beaded neck, which comprises on the one hand a plug having a tapped skirt adapted to be screwed on said neck and provided on the inner surface of its lower edge a groove adapted to receive the bead of said neck when said plug is screwed and driven home on said neck, and on the other hand a covering cap adapted to be fitted in smooth frictional engagement on the skirt of said plug and provided with a flexible top wall having a bulged central area, a circular abutment member formed on the outer surface of said top wall around said bulged central area, the height of said circular abutment member being at least equal to the height of said bulged central area, means in the form of cross-shaped ribs on the outer surface of the central area of said plug and projections registering with said ribs which are formed in the central area of said flexible bulged area of said cap, and a flexible strip projecting from said ribs and adapted to produce a rattle noise when engaging said projections during the rotation of said plug.

* * * * *